United States Patent [19]

Van Bogaert et al.

[11] Patent Number: 4,792,101

[45] Date of Patent: Dec. 20, 1988

[54] PROCESS FOR UNWINDING A THREAD FROM A REEL IN LOOMS, AND ARRANGEMENT USED THEREFOR

[75] Inventors: Philippe Van Bogaert, Brussels; Frank Ampe, Leffinge-Middelkerke; Jozef Verhulst, Zillebeke, all of Belgium

[73] Assignee: Picanol N.V., Belgium

[21] Appl. No.: 938,887

[22] Filed: Dec. 8, 1986

[30] Foreign Application Priority Data

Dec. 9, 1985 [NL] Netherlands ..... 8503385
Nov. 25, 1986 [BE] Belgium ..... 2/61091

[51] Int. Cl.[4] ..... B65H 49/02; B65H 59/00

[52] U.S. Cl. ..... 242/54 R; 242/128; 242/130; 242/131; 139/450; 139/452

[58] Field of Search ..... 242/130, 131, 131.1, 242/128, 54 R, 45, 18 R, 35.5 R, 130.1, 130.2; 57/352, 354, 356; 139/450, 452

[56] References Cited

U.S. PATENT DOCUMENTS 755,398 3/1904 Schwartz ..... 242/130
1,514,767 11/1924 Hill ..... 242/130
1,984,571 12/1934 Epps ..... 242/130
2,429,798 10/1947 Bradnack et al. ..... 242/131
2,534,339 12/1950 Chaya et al. ..... 242/131
3,011,736 12/1961 Furst et al. ..... 242/128
3,168,911 2/1965 Pfarrwaller et al. ..... 242/131 X
4,552,320 11/1985 Wust ..... 242/128
4,673,138 6/1987 Ichiba ..... 242/35.5 R

FOREIGN PATENT DOCUMENTS 485442 1/1918 France .
1575215 7/1969 France .
351203 12/1960 Switzerland .
2045295 10/1980 United Kingdom .

*Primary Examiner*—Stanley N. Gilreath
*Attorney, Agent, or Firm*—Bacon & Thomas

[57] ABSTRACT

Process for unwinding a thread from a reel in looms, wherein the thread (6) is guided through a thread guide (4) placed behind the reel, characterized thereby that the distance (L) between said thread guide (4) and said reel (3) is adjusted automatically mainly during the weaving process.

21 Claims, 4 Drawing Sheets

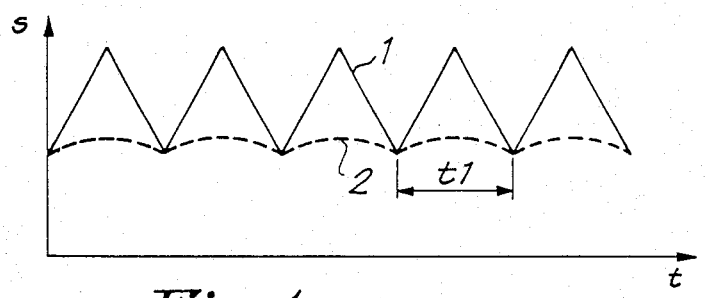
Fig. 1
Fig. 2
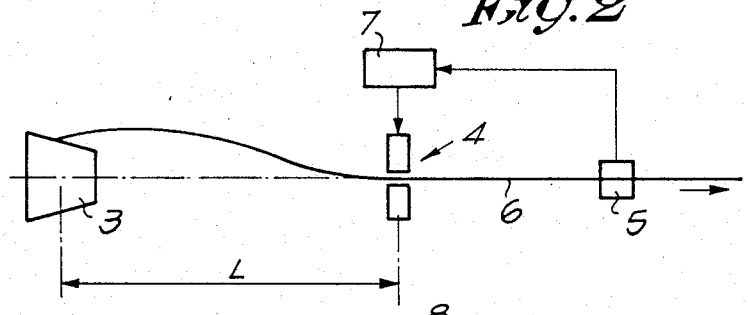
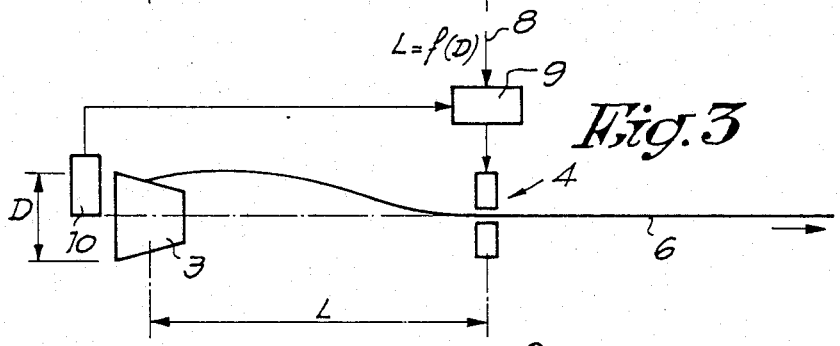
Fig. 3
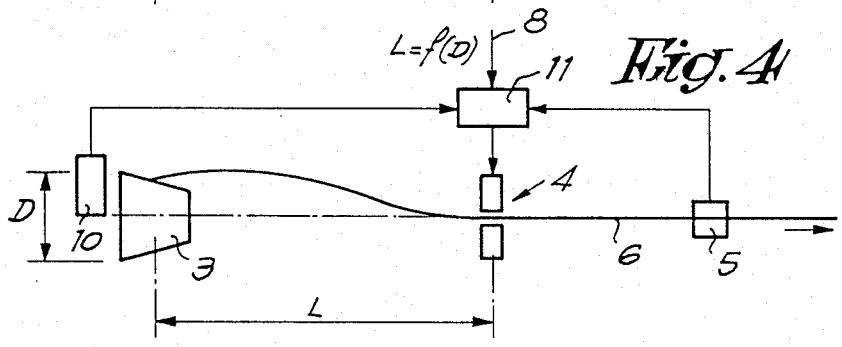
Fig. 4

Fig. 10
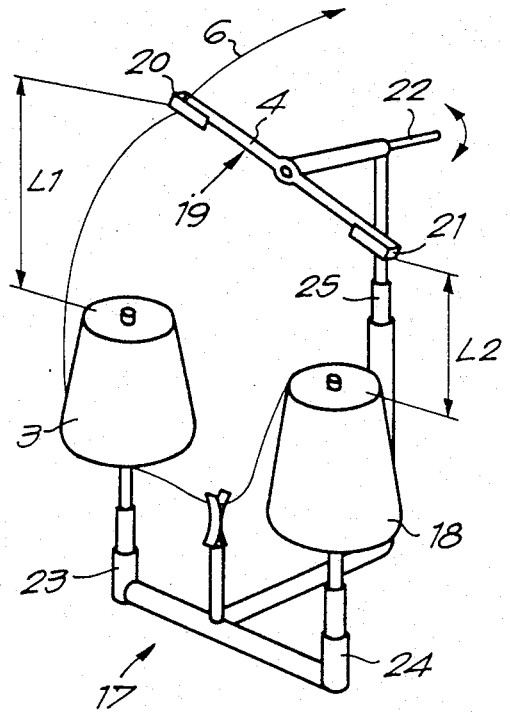
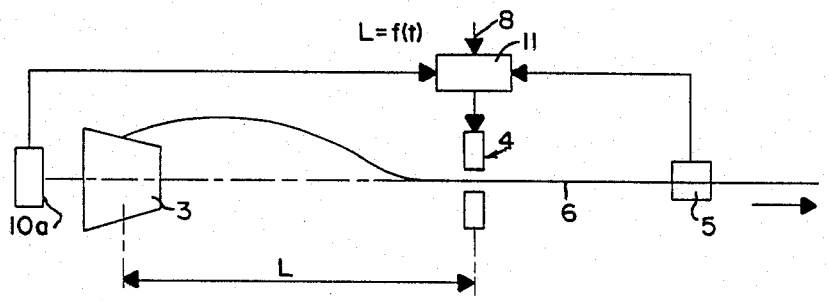
FIG 11

PROCESS FOR UNWINDING A THREAD FROM A REEL IN LOOMS, AND ARRANGEMENT USED THEREFOR

The present invention relates to a process for unwinding a thread from a reel in looms, as well as to arrangements that are used for realizing the process according to the invention.

It is known that in looms a thread guide, being mostly a thread eyelet, placed behind every reel along which the weaving thread is unwound from the reel. The distance between the reel and the thread guide can be adjusted herein in advance depending on the size of the reel in order to provide a smooth unwinding. The distance between the reel and the thread guide remains constant during the weaving process.

It has been determined experimentally that at high speeds of thread unwinding, relatively many thread breaks occur near the reel and the thread guide. It has been observed from tests and measurements that the forces arising upon unwinding the thread give rise in the weaving thread to stress peaks that may lead to the abovesaid thread breaks.

It also appeared from tests that there is an optimal distance between the reel and the thread guide, whereby the stress peaks or variations are minimal or are kept constant, and whereby the course of the stress in the thread as a function of time remains relatively constant. Said tests showed as well that this optimal distance depends on the diameter and the type of the reel, i.e. on the type of yarn and on the way of winding up the yarn.

In order to eliminate the above mentioned disadvantage of thread breaks, the invention provides a method for unwinding a thread from a reel according to which the stress variations in the threads are optimized i.e., minimized. For that purpose the invention consists in a method for unwinding a thread from a reel in looms, according to which the thread is guided through a thread guide and according to which the distance between the thread eyelet and the reel, mainly during the weaving process, is adjusted automatically. As will appear further on, it is clear that such a process can be brought about according to several variants. Preferably and mostly, adjusting occurs either directly or indirectly as a function of the thread stress. The present invention also relates to the arrangements for realizing said method.

For better elucidating the features of the invention some preferred embodiments of such arrangements are described below by way of examples without limiting the invention thereto and with reference to the accompanying drawings wherein:

FIG. 1 represents the course of the stress in the weaving thread near the thread guide for a non-adjusted as well as for an adjusted arrangement according the present invention;

FIG. 2 represents schematically an arrangement wherein the distance between the reel and the thread guide is adjusted as a function of the stress in the thread;

FIG. 3 represents schematically an arrangement wherein adjusting the distance between the reel and the thread guide occurs as a function of the diameter of the reel;

FIG. 4 represents schematically an arrangement wherein the distance between the reel and the thread guide occurs as a function of the diameter of the reel as well as of the stress in the thread unwound from the reel;

FIG. 10 represents a variant of the embodiment according to FIGS. 7 to 9 and FIG. 11 shows a variant of the invention illustrated in FIG. 4.

Figure 5:
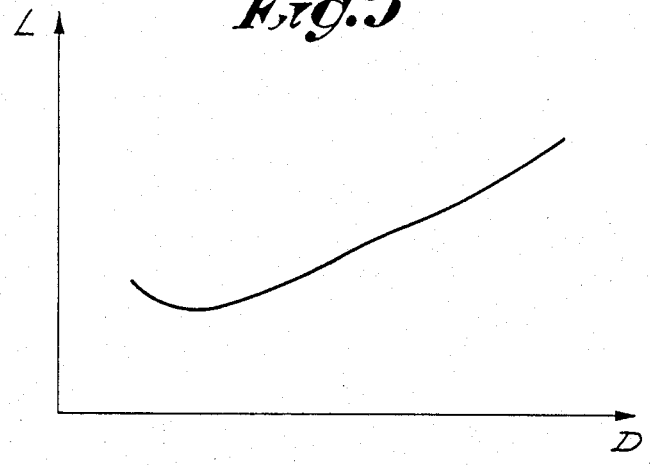
FIG. 5 represents for a determined reel a function of the optimal distance L versus the diameter D.

In FIG. 1 the course of the stress S in the thread is represented versus time t by means of two curves 1 and 2, of which curve 1 represents the course in the case of a badly chosen distance between the reel and the thread guide, whereas curve 2 applies to an optimally adjusted distance L. It is clear that variations or peaks of stress such as those occuring in curve 1 have to be avoided in order to exclude thread breaks. It is remarked that in this FIG. 1, starting from a determined situation of unwinding, the time t1 equals the time that is needed for arriving again at said substantially same situation of unwinding. So, in the FIGS. 2 and 3 various arrangements are represented wherein one aims at automatically adjusting the distance L between a reel 3 and a thread guide 4 in an optimal or almost optimal way.

In the embodiment according to FIG. 2 the arrangement in addition to reel 3 and thread guide 4 consists of a mechanism (not specifically represented in the figure) for adjusting the distance L between the reel 3 and the thread guide 4; a measuring device 5 for measuring the course of the stress in the thread 6, and a processing unit 7 providing the coupling between the measuring device 5 and said mechanism for adjusting the distance L. In general, the distance L is increased with increasing tension in the thread. However, the optimum distance may vary depending on the winding method on the reel and the kind of thread used. The processing unit 7 is equipped with built in logics so as to adjust the distance L in such a way that the stress variations in the thread 6 be minimal or at least be maintained as constant as possible. It is clear that herein the measuring device 5 can equally well consist of a means to measure the length of unwound thread passing the device or a stress meter as a stress-variation meter.

The process followed herein can simply be deduced from the schematical representation of FIG. 2 and consists in directly adjusting the distance L between the thread guide 4 and the reel 3 as a function of the thread stress S by measuring the stress in the thread 6 and by automatically adjusting the distance L as a function of the measured stress S. This process offers the advantage that the slightest stress variation is immediately determined and corrected.

In FIG. 3 an arrangement is represented wherein the distance L between the reel 3 and the thread guide 4 is adjusted indirectly as a function of the stress in thread 6. Herein, the optimal distance L is determined in advance as a function of the diameter of a determined type of reel 3. Thereby a parameter 8 is obtained, which is put in a processing unit 9. Said processing unit 9 is then controlled by means of a measuring device 10, that continuously measures the diameter D of the reel 3 during the weaving process. As has been said above, the processing unit 9 controls a mechanism for adjusting the distance L between the reel 3 and the thread guide 4. Generally, the distance L decreases as the diameter of the reel decreases, however, the optimum distance may vary, depending on the winding method on the reel and the kind of thread used.

Such a dependency of the distance L upon the diameter D of the reel is represented in FIG. 5.

Summarizing, the method followed herein shows the feature that the distance L between the thread guide 4 and the reel 3 is adjusted by determining the momentary diameter D of reel 3 and by automatically adjusting the distance L as a function of the determined diameter, wherein thus a parameter 8 or a functional relation is used from which is expected that an optimal course of stress is obtained when it is applied.

Determining the diameter D does not necessarily take place by means of the direct measurment thereof as is represented in FIG. 3.

According to a variant, the diameter D can also be determined from other measuring values, e.g. by means of transfer functions. Preferably the time T of unwinding the reel is then measured, from which the diameter is calculated by means of a previously fixed transfer function $D=f(T)$.

According to another embodiment the distance L is adjusted directly as a function of the measured time T of unwinding.

According to still another variant, the distance L is adjusted as a function of the amount of thread 6 taken off which could be directly measured by a suitable means known in the art. Measuring device 5, for example, could be a length measurer.

FIG. 4 provides an arrangement which is a combination of the arrangements according to FIGS. 2 and 3. So, the processing unit 11 provides the coupling of both measuring devices 5 and 10 for the stress and the reel diameter D respectively, with the mechanism for adjusting the distance L between reel 3 and the thread guide 4. Further, the above-said parameter 8 is put in the processing unit 11.

The process applied to this arrangement mainly shows the feature that it consists in measuring the stress S in the thread 6, measuring the diameter D of reel 3, and adjusting the distance L between said reel 3 and the thread guide 4 as a function of the measured stress S as well as of the measured diameter D. This process offers the advantage that the information on the diameter allows a quick adjustment when the reels are changed, whereas the information on the stress provides an additional adjustment. It is also possible to adapt the distance L as a function of the diameter D during the weaving process such that the additional adjustment becomes minimal. It is still possible to store the former measured distances L in a memory. This allows, e.g., upon changing reels to bring the thread eyelet directly to a position where said thread eyelet stood optimally at the preceding change of reels.

It is clear that also in the embodiment according to FIG. 4 the measurement of diameter can be replaced by the measurement of unwinding time, wherein of course a suitable timer 10*a* and a suitable processing unit has to be applied as illustrated in FIG. 11.

It is also possible upon starting up the machine to impose to the eyelet a determined motion and to adapt this motion to every start in such a way that the stress peaks during starting-up are minimised.

Obviously, the reel 3 as well as the thread guide 4 in the above-said arrangements can be adjusted. The mechanism for regulating the distance L and for adjusting the thread guide 4 in itself can be made according to many variants. According to a possible embodiment, the thread guide 4 is placed on a telescopic arm, that can be extended, e.g., by means of some worm or the like built in said arm.

Adjusting the position of said thread guide 4 with regard to reel 3 preferably occurs by a usual proportionally integrating differentiating adjustment (PID-adjustment).

Figure 6:
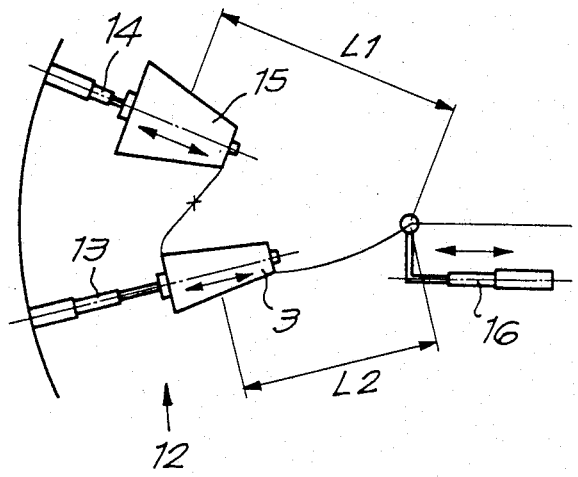
FIG. 6 represents a mechanism for adjusting the distance between the reel and the thread guide.

As is represented in FIG. 6, adjusting the distance L preferably occurs by a suitable construction of the reel stand. The reel stand 12 is formed herein by telescopic arms 13 and 14, to which are mounted the reels 3 and 15 respectively. In the same way also the thread guide 4 can be fixed to a telescopic arm 16. By a suitable adjustment of the various telescopic arms, the distance L can be adjusted as aforesaid. The telescopic arm embodiment allows that in the case of a transition between two successive reels 3 and 15, an optimal distance L1 and L2 can be maintained between the respective reels and the thread guide 4.

Figure 7:
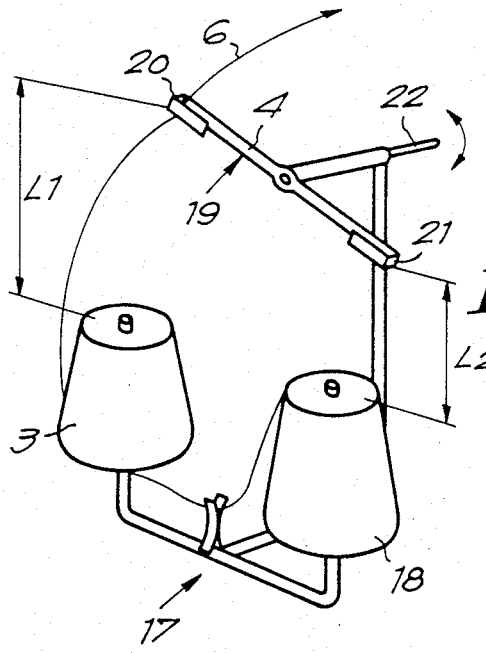
FIGS. 7 to 9 represent an embodiment wherein the distance between the operating reel and the thread guide can be modified through a revolving mounting of the latter.
Figure 8:
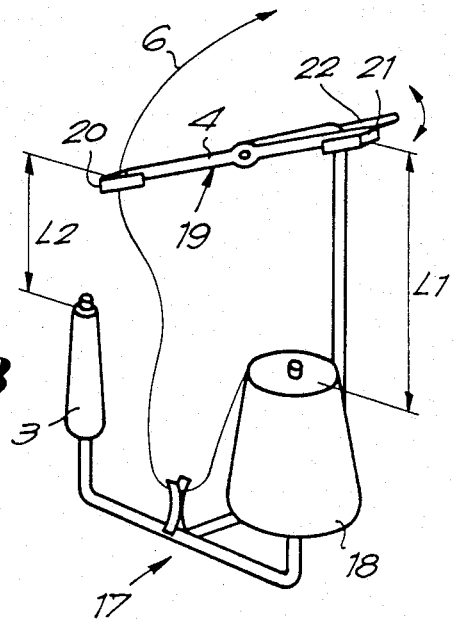
Figure 9:
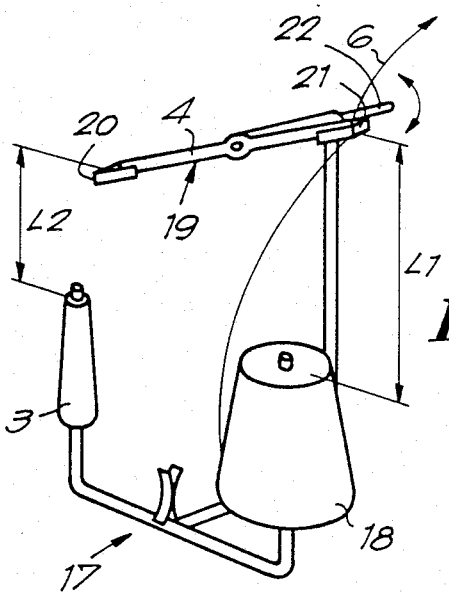

In the FIGS. 7 to 9 another mechanism for adjusting the aforesaid distance L is represented. It consists of a reel arrangement 17 comprising two reels 3 and 18 respectively, and a thread guide 4 arranged symmetrically with regard to them and comprising an elongated thread-guiding opening 19. The thread guide 4 is rotatably fixed between its both ends 20 and 21 in such a way that when the distance between the end 20 and the reel 3 grows, the distance between the end 21 and the reel 18 is reduced, and conversely. At the beginning of the first reel 3, the end 20 is placed at the optimal distance L1 as represented in FIG. 7. When reel 3 is unwound the end 20 finds itself at an optimal distance L2, and also the end 21 has come to the optimal distance L1 from reel 18. When the reels are changed, thread 6 moves from the end 20 to the end 21, which has the advantage that the optimal distance L1 of the full reel 18 is reached immediately so that no sudden adjustment of the thread guide 4 is necessary. FIG. 9 represents the new situation.

Of course, the revolving thread guide 4 of the embodiment according to FIGS. 7 to 9 is equipped with the necessary control means for adjusting the right rotation thereof. This means is e.g. a step motor or the like, which rotates the spindle 22 in a regulated way, optionally with the help of a belt transmission.

In one embodiment, the reels 3 and 18 can be mounted telescopically, e.g. as is represented in FIG. 10. In addition to the telescopic arms 23 and 24 whereby the reels 3 and 18 can be moved, also a telescopic arm 25 can be provided for moving the revolving thread guide up and down. Adjustment of the distance L is achieved by a suitable combination of motions made by the various components.

The present invention is by no means limited to the embodiments represented in the accompanying drawings and described by way of examples, but such an arrangement can be realized in any form without departing from the scope of the invention.

We claim:

1. A process for unwinding a thread from a reel used in a weaving loom wherein the maximum stress in said thread during unwinding is reduced, comprising the steps of:

(a) guiding said thread through a thread guide that is movable relative to the reel so as to effect adjustment of the distance between the guide and the reel;

(b) positioning said thread guide at a first distance relative to said reel and unwinding thread from the reel through the guide by a weaving loom;

(c) determining the tension of said thread between said thread guide and loom while it is unwound from the reel by the loom;

(d) adjusting the distance of said thread guide relative to said reel during weaving by the loom in response to the tension determination so that the thread guide is always positioned so as to minimize the stress variation in the thread during unwinding.

2. A process for unwinding a thread from a reel according to claim 1, wherein the thread tension is determined by directly detecting same.

3. A process for unwinding a thread from a reel according to claim 1, wherein the thread tension is determined indirectly by measuring a variable affecting thread tension other than the thread tension itself.

4. A process for unwinding a thread from a reel according to claim 1, wherein the thread tension is determined directly by detecting same and indirectly by measuring a variable affecting thread tension other than the thread tension itself.

5. A process for unwinding a thread from a reel according to claim 3, wherein said determination of thread tension includes determining an instantaneous diameter of said reel and carrying out said adjustment of said distance as a direct function of said instantaneous diameter.

6. A process for unwinding a thread from a reel according to claim 5, including determining said instantaneous diameter of said reel by the additional steps of: determining a transfer function which relates said reel diameter to a rate of unwinding of said reel with respect to time; measuring a time period of unwinding of said reel; and calculating said instantaneous diameter of said reel from said time period and said transfer function.

7. A process for unwinding a thread from a reel according to claim 4, wherein said indirect determination of tension is carried out by determining an instantaneous diameter of said reel, and automatically adjusting said distance as a function of both said direct measured tension and said instantaneous reel diameter.

8. A process for unwinding a thread from a reel according to claim 3, wherein said determination of thread tension includes determining a time period required to unwind said reel and adjusting said distance as a function of said time period.

9. A process for unwinding a thread from a reel according to claim 3, wherein said determination of thread tension includes determining an amount of thread unwound from said reel and adjusting said distance as a function of said amount of unwound thread.

10. A process of unwinding a thread from a reel according to claim 3, including the additional steps of:

providing a supply of additional new reels to permit a transition from said reel to a new reel when said reel is completely unwound; and automatically adjusting said distance of said thread guide relative to said reel and each said new reel at said transition so that said stress variation in the thread is minimized during and following each transition between reels.

11. In an apparatus for unwinding a thread from a reel used in a weaving loom wherein the variation in stress of said thread during unwinding is minimized, said apparatus including a reel upon which said thread is wound, a thread guide positioned at a distance from said reel, said thread being pulled through said thread guide as it is pulled from said reel; the improvement comprising:

means for adjusting said distance of said thread guide from said reel;

means for determining the variation in tension of said thread and generating a thread tension signal; and a processing unit having means providing communication between said tension determining device, said processing unit, and said adjusting mechanisms, said processing unit arranged to receive said thread tension signal and, in response to said thread tension signal, to generate a thread guide distance signal that corresponds to a distance between the thread guide and the reel whereat stress variation in the thread during its unwinding from the reel is minimized, said adjusting means being arranged to receive said thread guide distance signal and to position the thread guide at said distance in response to said thread guide distance signal.

12. In an apparatus for unwinding a thread from a reel used in a weaving loom wherein the variation in stress of said thread during unwinding is minimized, said apparatus including a reel upon which said thread is wound, a thread guide positioned at a distance from said reel, said thread being pulled through said thread guide as it is pulled from said reel; the improvement comprising:

means for adjusting said distance of said thread guide from said reel;

means for determining the diameter of said reel and for generating a reel diameter signal; and a processing unit having means for providing communication between said reel diameter determining device, said processing unit, and said adjusting mechanism, said processing unit arranged to receive said reel diameter signal, and, in response to said reel diameter signal, to generate a thread guide distance signal that corresponds to a distance between said thread guide and the reel whereat stress variation in the thread during its unwinding from the reel is minimized, said adjusting mechanism being arranged to receive said thread guide distance signal and to position the thread guide at said distance.

13. The improvement as claimed in claim 11, including an additional determining device arranged to determine the diameter of said reel and to generate a reel diameter signal, said processing unit arranged to receive said reel diameter signal and, in response to said thread tension signal and said reel diameter signal, to generate said thread guide distance signal.

14. The improvement as claimed in claim 11, wherein said means for determining thread tension comprises a thread stress detector.

15. The improvement as claimed in claim 11, wherein said means for determining thread tension comprises a stress-variation detector.

16. In an apparatus for unwinding a thread from a reel used in a weaving loom in a manner whereby the stress of said thread during unwinding is minimized, said apparatus including a reel stand having two reels mounted thereon, a thread guide arranged to receive thread from either of said reels, thread from either reel being pulled through said thread guide as it is pulled from either reel; the improvement comprising:

a mechanism for adjusting said distance of said thread guide from said reels;

a device for determining the variation in tension of said thread and generating a thread tension signal; and a processing unit having means providing communication between said thread tension variation determining device, said processing unit, and said adjusting mechanism, said processing unit arranged to receive said thread tension signal and, in response to said thread tension signal, to generate a thread guide distance signal that corresponds to a distance between the thread guide and the reels whereat stress variation in the thread during its winding from each reel is minimized, said adjusting mechanism being arranged to receive said thread guide distance signal and to position the thread guide at said distance during unwinding of thread from each reel.

17. The improvement as claimed in claim 16, wherein said thread guide includes an elongated thread guide opening and is rotatably mounted on said reel stand for pivotal movement about an axis located between the ends of said opening; said adjusting means being arranged to position the thread guide at said distance by rotating said thread guide about said pivotal axis.

18. The improvement as claimed in claim 11, wherein said means for adjusting said distance of said thread guide from said reel includes a telescopically movable arm arranged to support said reel.

19. The improvement as claimed in claim 11, wherein said means for adjusting said distance of said thread guide from said reel includes a telescopically movable arm arranged to support said thread guide.

20. The improvement as claimed in claim 16, wherein said means for adjusting said distance of said thread guide from said reels includes telescopically movable arms arranged to support said reels.

21. The improvement as claimed in claim 16, wherein said means for adjusting said distance of said thread guide from said reels includes telescopically movable arms arranged to support said reels and said thread guide.

* * * * *